United States Patent [19]

Chung et al.

[11] Patent Number: 5,049,087

[45] Date of Patent: Sep. 17, 1991

[54] ELECTRICAL CONNECTOR USING FLEXIBLE CIRCUIT TAPE

[75] Inventors: Chang-Hwa Chung, San Jose, Calif.; Thomas H. Hunter; Robert H. Haskell, Jr., both of Austin, Tex.

[73] Assignee: Microelectronics and Computer Technology Corporation, Austin, Tex.

[21] Appl. No.: 604,048

[22] Filed: Oct. 26, 1990

Related U.S. Application Data

[63] Continuation-in-part of Ser. No. 558,936, Jul. 27, 1990, which is a continuation-in-part of Ser. No. 389,927, Aug. 4, 1989, abandoned.

[51] Int. Cl.[5] ..... H01K 13/629

[52] U.S. Cl. ..... 439/259; 29/860; 29/878; 439/62; 439/329; 439/493

[58] Field of Search ..... 439/62, 67, 83, 259, 439/261, 325, 327, 329, 393, 395, 396; 29/860, 878; 174/117 F, 117 FF

[56] References Cited

U.S. PATENT DOCUMENTS

| | | | |
|---|---|---|---|
| 4,636,019 | 1/1987 | Gillett et al. | 439/62 |
| 4,815,979 | 3/1989 | Porter | 439/62 |
| 4,895,523 | 1/1990 | Morrison et al. | 439/67 |
| 4,907,975 | 3/1990 | Dranchar et al. | 439/67 |

*Primary Examiner*—Eugene F. Desmond
*Attorney, Agent, or Firm*—Fulbright & Jaworski

[57] ABSTRACT

An electrical connector having first and second coacting parts which include spaced electrical contacts uses a flexible electrical tape having lead ends for connection to a circuit board. Side panels protect the lead ends from damage, during storage and shipment in one position and are releasably connected in a second position to provide support on the leads for bonding. After bonding, the side panels protect the flexible tape from operational damage.

12 Claims, 4 Drawing Sheets

ELECTRICAL CONNECTOR USING FLEXIBLE CIRCUIT TAPE

CROSS-REFERENCE TO RELATED APPLICATIONS

This application is a continuation-in-part of U.S. Ser. No. 558,936, filed July 27, 1990, entitled "Electrical Connector System" and currently pending; which is a continuation-in-part of U.S. Ser. No. 389,927, filed Aug. 4, 1989, entitled "Electrical Connector System" and currently abandoned.

BACKGROUND OF THE INVENTION

It is known as described in U.S. patent application Ser. No. 389,927, filed Aug. 4, 1989, to provide an electrical connector having first and second coacting parts, each of which includes a plurality of spaced electrical contacts formed by flexible electrical tapes for connection to the contacts on the other part.

However, after the electrical connector is manufactured, it may be stored, and/or shipped to an end user prior to the connection of a circuit board to the connector. During storage, shipment or connection of a circuit board to the electrical connector, the leads of the flexible circuit tape, which are quite fragile, are subject to damage.

The present invention provides an electrical connector having one or more side panels which are releasably connected to the connector for movement to various positions. In one position, the ends of the flexible circuit tape are protected from damage during storage or shipment. In another position, a compressive force is applied against the leads, during the bonding of a circuit board to the connector, to maintain contact and alignment with bond pads on the circuit board. This feature enhances the bondability and reliability of the bonding process. After bonding, the side panel is designed to protect the flexible tape circuit from installation damage.

SUMMARY

The present invention is directed to an electrical connector having first and second coacting and releasable parts, each of the parts including a plurality of spaced electrical contacts for connection to the contacts on the other part. The electrical contacts on the second part include a flexible electrical tape having a plurality of lead ends for connection to a circuit board. Means are provided on the second part for coacting with and receiving a circuit board. A side panel having a lead support shoulder is releasably connected to the outside of the second part in first or second positions. In the first position the panel encloses and protects the lead ends of the flexible tape. In the second position the lead support shoulder engages the lead ends adjacent to but spaced from the ends for providing support for bonding the ends to a circuit board.

Preferably, the side panel is movable between the first and second positions in a direction transversely to the flexible tape for avoiding a scraping contact on the tape between positions.

A further object is wherein one form of the releasable connection between the side panel and the second part may include pins and holes. In another embodiment, the releasable connection may include a pin and slot connection. And in still further embodiments, the connection may include a threaded bolt or pin.

Yet a further object of the present invention is wherein a dummy circuit board is initially releasably connected to the second part for use during storage and shipment for protecting the lead ends of the flexible tape.

Still a further object of the present invention is wherein the second part includes first and second edges and opposite sides and a flexible electrical tape having a plurality of lead ends at each end for connection to a circuit board is wrapped around the second edge of the first part and extends on opposite sides to adjacent the first edge of the second part. First and second side panels are provided each having a lead support shoulder and the side panels are releasably connected to opposite sides of the second part in a first or second position. The panels protect the lead ends in the first position and in the second position the lead support shoulders engage the ends of the flexible tape for providing support and compression for bonding the ends of the tape to a circuit board.

Another object of the present invention is the provision of a method of protecting the ends of a flexible circuit tape and an electrical connector having first and second coacting and releasable parts in which the second part includes a flexible electrical tape having a plurality of lead ends extending along a side to adjacent an edge of the second part. The method includes releasably connecting a side panel to the side of the second part in which the side panel extends beyond the edge of the first part further than the lead ends of the tape for protecting the tape ends. The method also includes connecting a circuit board to the second part on one side of the lead ends of the tape, moving the side panel to a position exposing the tape ends, compressing the lead ends against the circuit board by the side panel while connecting the side panel to the side of the second part, and bonding the lead ends to the circuit board.

A further object of the present method is initially connecting a dummy circuit board to the second part on the one side of the lead ends of the tape for protecting the lead ends and removing the dummy prior to connecting an active circuit board.

A further object of the present invention includes the step of moving the side panel transversely to the flexible tape before moving the side panel to a position exposing the tape ends thereby avoiding damage to the tape by the side panels.

Still a further object of the present invention is a method of protecting the ends of a flexible tape in an electrical connector in which the second part of the connector includes first and second edges and opposite sides between the edges. The flexible electrical tape, which includes a plurality of lead ends at each end for connection to a circuit board, is wrapped around the second edge of the second part and extends on opposite sides with each of the ends positioned adjacent the first edge of the first part. The method includes releasably connecting a side panel having a support shoulder to each side of the second part in a first position in which the shoulders extend beyong the lead ends of the tape for protecting the tape ends during storage or shipment. The method includes connecting a circuit board to the first edge of the second part between the ends of the tape, moving the side panels to a second position exposing the tape ends, compressing the lead ends against the circuit board by the support shoulders, and bonding the lead ends to the circuit board.

A further object of the present invention is protecting the ends of the flexible tape by the shoulders while connecting the circuit board to the second part.

Other and further objects, features and advantages will be apparent from the following description of presently preferred embodiments of the invention, given for the purpose of disclosure, and taken in conjunction with the accompanying drawings.

DESCRIPTION OF THE PREFERRED EMBODIMENTS

While the present invention may be used in various types of electrical connectors, the invention will be described, for purposes of illustration only, in conjunction with one particular type of connector.

Figure 1:
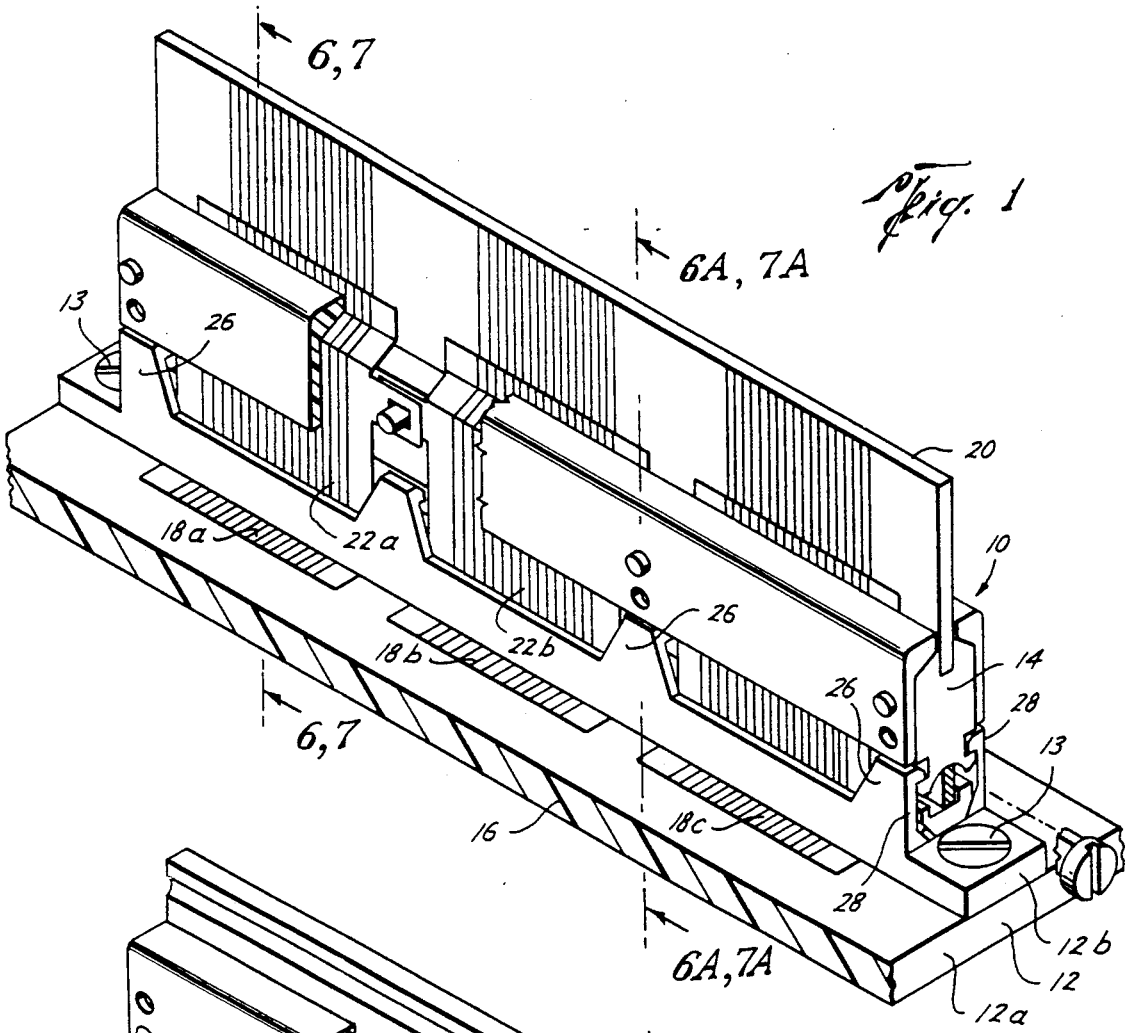
FIG. 1 is a perspective elevational view, partly in cross section, and partly exploded showing a fully completed electrical connector of the present invention.
Figure 2:
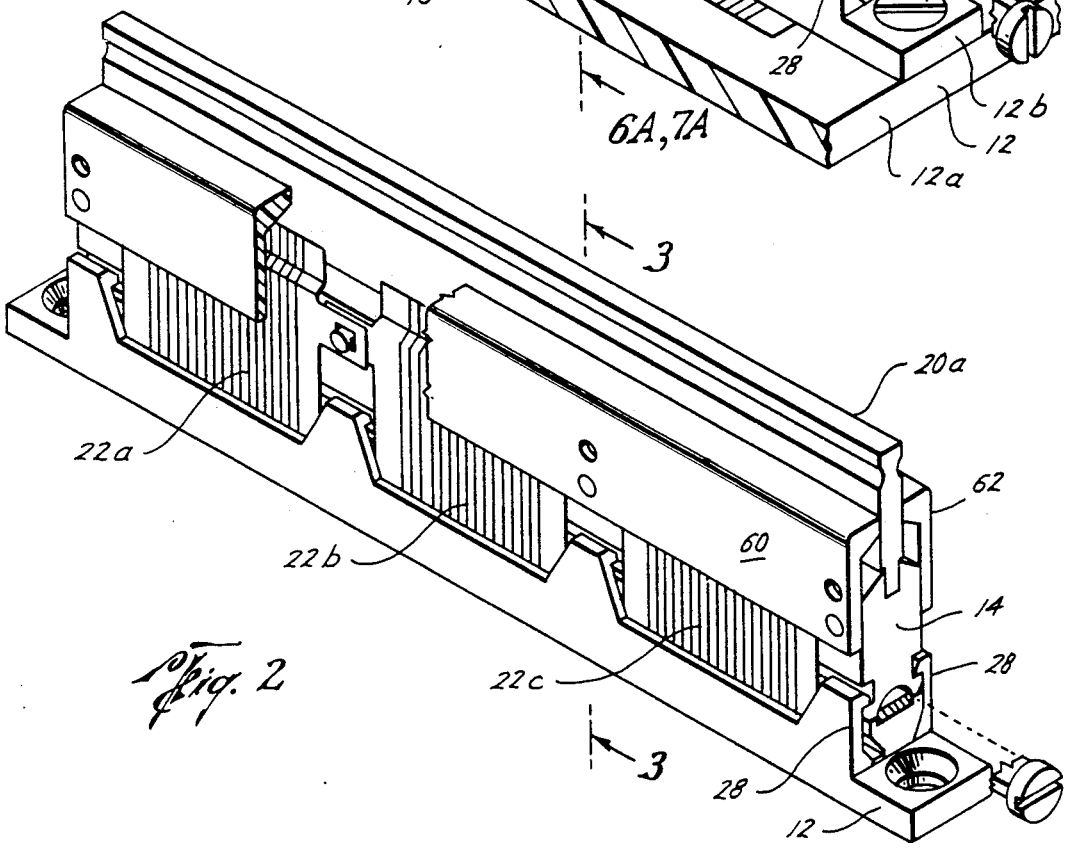
FIG. 2 is a perspective elevational view of a portion of the connector of FIG. 1 in a storage and/or shipping position.
Figure 6:
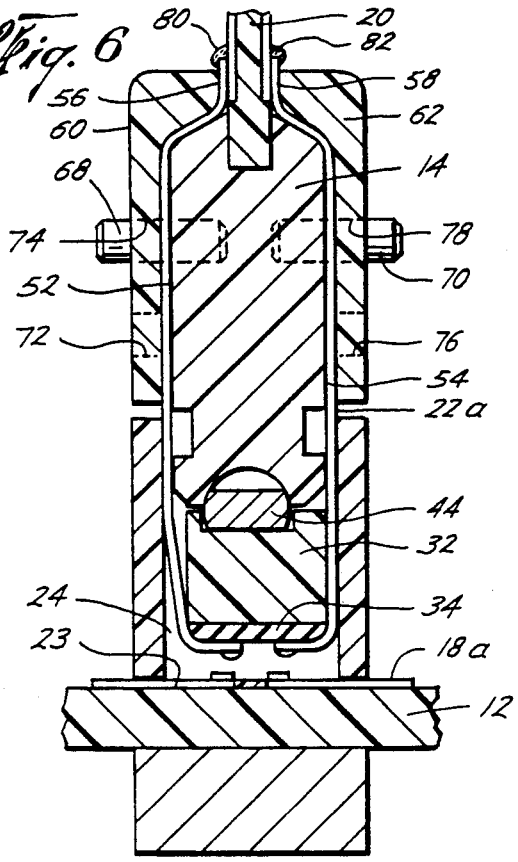
FIG. 6 is a cross-sectional view taken along the line 6—6 of FIG. 1, showing the completed connection of the circuit board to the connector and with the first and second parts of the connector engaged without electrical contact.
Figure 7:
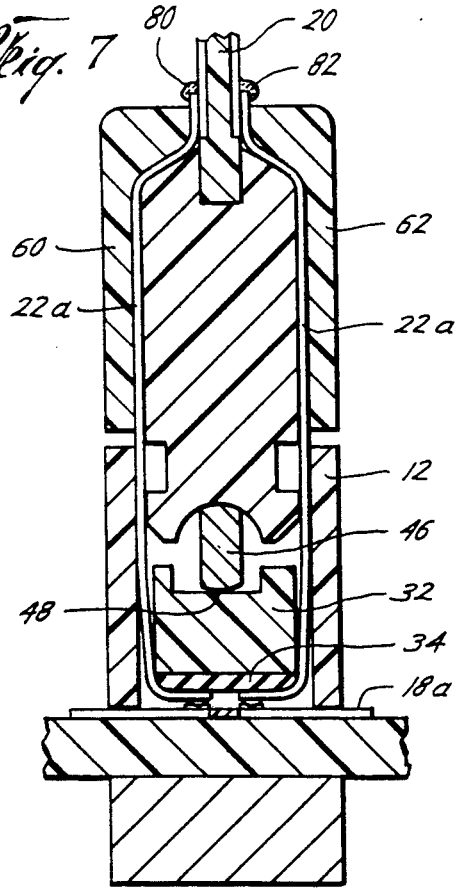
FIG. 7 is a cross-section, taken along line 7—7 of FIG. 1 and is a view similar to FIG. 6 but with the cam rotated and electrical contacts engaged.

Referring now to the drawings, and particularly to FIG. 1, the electrical connector of the present invention is generally indicated by the reference numeral 10 and generally includes a first part 12 and a second part 14 which are coacting, engagable and releasable longitudinal extending parts. Each of the parts 12 and 14 include a plurality of spaced electrical contacts for connection to the contacts on the other part. For example, the part 12 may include a motherboard having a plurality of modules 18*a*, 18*b*, and 18*c*, preferably of a flexible circuit tape such as a TAB tape overlay on the surface of the motherboard 16, wherein each module contains a plurality of electrical contacts. Similarly, the second part 14 may include a daughterboard 20 having a plurality of modules, wherein each module contains a plurality of electrical contacts such as flexible circuit tapes 22*a*, 22*b*, and 22*c*. As best seen in FIGS. 6 and 7, the first part 12 includes windows 23 in which each of the modules 18*a*, 18*b* or 18*c* containing electrical contacts are separately positioned. The first part 12 includes an opening 24 for receiving the lower portion of the second part 14. Each of the modules 22*a*, 22*b* and 22*c* of the electrical contacts, as best seen in FIGS. 6 and 7, extend around the bottom edge of the second connector part 14 with a slight amount of slack therein, and are connected on opposite sides 52 and 54 on the part 14. Thus, when the second part 14 is inserted into the opening 24 of the first part 12, the electrical contacts on the second part 14 are positioned adjacent the electrical contacts on the first part 12 for engagement.

A latching and unlatching mechanism 26 is connected between the first part 12 and the second part 14 and positioned one each side of the modules 22*a*, 22*b* and 22*c*. The mechanism 26 includes latching arms 28 on one part, here shown as on part 12, and latch shoulders 30 on the other part, here shown as part 14. The latching arms 28 are resilient and therefore the parts 12 and 14 may be manually latched and unlatched.

A longitudinally extending loading and wiping block 32 extends through the second connector part 14 adjacent the modules 22*a*, 22*b* and 22*c*, and also extends through the latching and unlatching mechanism 26. At the locations in which the block 32 extends through the modules 22*a*, 22*b* and 22*c* of electrical contacts, as best seen in FIGS. 6 and 7, the block 32 may be generally rectangular in cross section, and a resilient pad 34 is provided between the block 32 and the modules 22*a*, 22*b* and 22*c*.

Figure 6A:
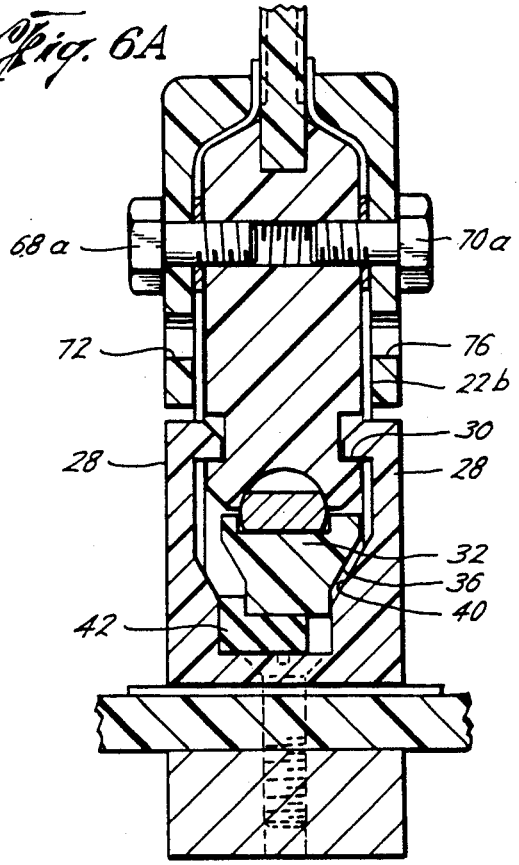
FIG. 6A is a cross-sectional view taken along the line 6A—6A of FIG. 1 but in which the releasable connection includes a threaded bolt.
Figure 7A:
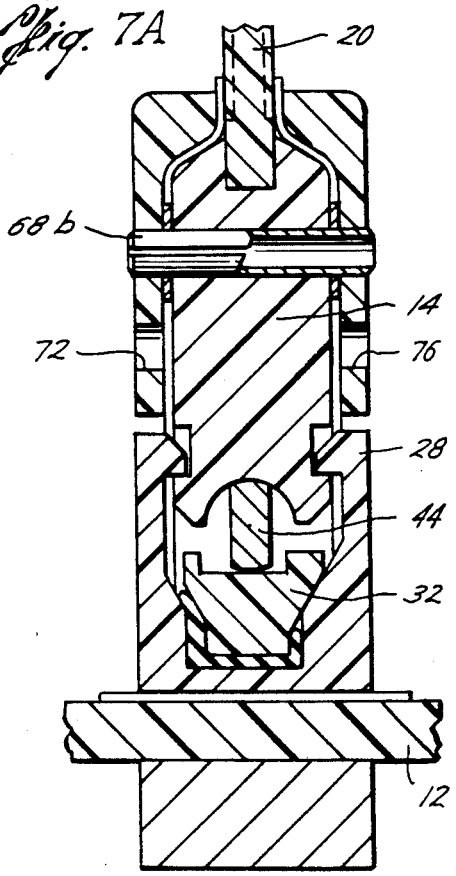
FIG. 7A is a cross-sectional view taken along line 7A—7A of FIG. 1 with the cam rotated and utilizing a different releasable means.

In the latching and unlatching mechanism stations 26, the block 32 is provided with an inclined surface 36, FIGS. 6A and 7A, which coacts with the inclined surface 40 on the first part 12. Thus, as the block 32 moves downwardly to bring the electrical contacts on the second part 14 into engagement with the electrical contacts on the first part 12, due to the flexible slack in the flexible tapes 22*a*, 22*b* and 22*c*, the inclined surfaces 36 and 40 will engage (FIG. 7A) causing the block 32 to move transversely to the longitudinal axis of the connector 10 to bring a wiping action between the contacts on part 12 with the electrical contacts on the second part 14 (FIG. 7). A biasing means, such as a resilient elastomer 42, is provided on the connector part 12 for engagement with the block 32 for biasing the inclined surfaces 36 and 40 together for creating a wiping action between the electrical contacts on the first part 12 and the second part 14.

Rotatable cam means 44 are provided between the loading and wiping block in the second part 14 for moving the block 32 towards the first part 12. When the parts 12 and 14 are engaged thereby bringing the electrical contacts on the second part 14 into a wiping engagement with the electrical contacts on the first part 12, as best seen in FIG. 6, the second connector part 14 is latched in the first connector part 12, but the electrical contacts are not in engagement. The cam 44 has a flat cam surface 46 and a second greater radially distant cam surface 48. Initially the first surface 46 is in engagement with the top of the block 32 allowing the block 32 and the electrical contacts on the part 14 to be in a retracted position. However, when the cam 44 is rotated 90°, the block 32 is displaced downwardly by the cam surface 48 causing the inclined surfaces 36 and 42 to engage. This causes the block 32 to move both downwardly and transversely to provide a wiping action of the electrical contacts in the flexible slackened modules 22*a*, 22*b* and 22*c* of part 14 relative to the contacts in the modules 18*a*, 18*b* and 18*c* of part 12. When the cam 44 is rotated 90°, the surface 48 is brought into a locking engagement with the top of the block 32 holding the engaging electrical contacts in a locked position.

The above described electrical connector is generally described in U.S. patent application Ser. Nos. 389,927 and 558,936 which are each hereby incorporated by reference.

However, the connector 10 as manufactured includes the first part 12, the second part 14 along with the flexible tape modules 22*a*, 22*b*, 22*c*, 18*a*, 18*b* and 18*c*, but without the daughterboard 20. That is, while the connector consisting of parts 12 and 14 is suitable for interconnection between various types of electrical circuits, the electrical circuits on the daughterboard 20, which may be a conventional printed circuit board, may vary. Therefore, the parts 12 and 14 are manufactured and sold without board 20, allowing the customer to connect its own board 20 having its particular electrical circuit. However, this leaves the lead ends of the flexible tape modules 22*a*, 22*b*, and 22*c* upstanding, and unprotected during storage, transportation, and prior to connection to a daughterboard 20. The leads of the flexible tapes 22*a*, 22*b*, and 22*c* are fragile and need protection. For example, in a typical TAB flexible circuit tape, there may be 200 leads per inch and the leads are 2 mils wide and a half a mil thick. Therefore, the present invention is provided to protect the flexible circuit tapes during storage, shipment to the end user, and to assist in bonding the lead ends of the tape to the circuit board 20.

Figure 4:
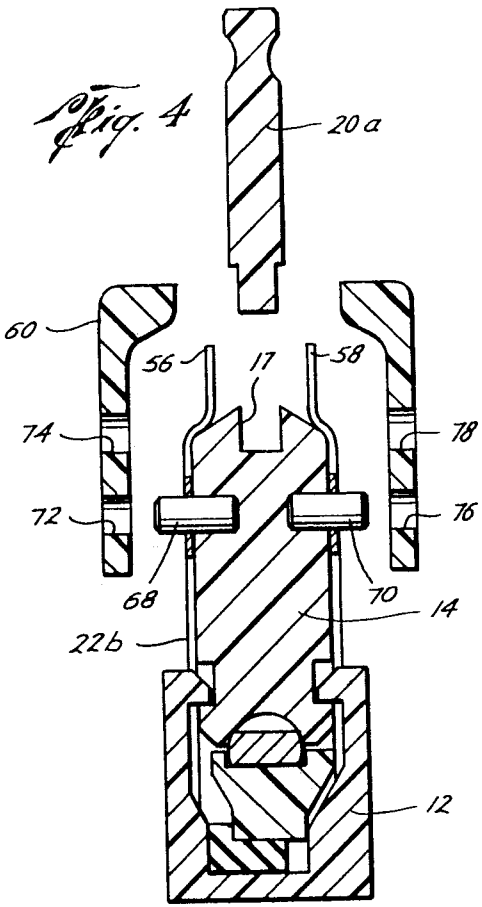
FIG. 4 is a view similar to FIG. 3 showing the position of the parts in a further step in the preparation for connection to a circuit board.
Figure 3:
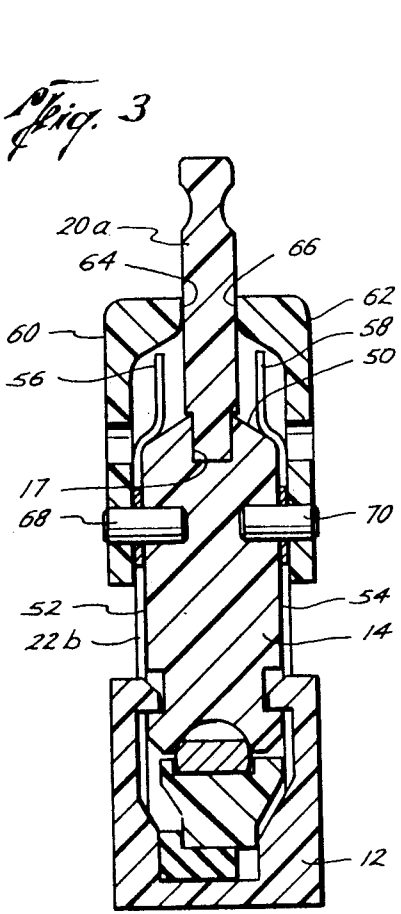
FIG. 3 is an enlarged cross section, taken along line 3—3 of FIG. 2.

The connector part 12 may consist of member 12*a* and 12*b* which are connected together by screws 13, but are normally disconnected for shipping. Referring now to FIGS. 3 and 4, it is noted that the second part 14 of the connector 10 has a first edge 50, and opposite sides 52, and 54. The flexible circuit tape 22*a* is wrapped around a lower edge of the part 14 and up on the opposite sides 52 and 54 leaving the lead ends 56 and 58 adjacent the first edge 50 of the part 14 for bonding to a daughterboard 20 (FIG. 1). First and second side panels 60 and 62 are provided on the opposite sides 52 and 54, respectively, of the part 14. The side panels 60 and 62 include lead support shoulders 64 and 66, respectively. The side panels 60 and 62 are releasably connected to the outside of the second part 14 in first and second positions. As best seen in FIG. 3, the side panels 60 and 62 are releasably connected to the part 14 in a first position wherein the side panels enclose and protect the lead ends 56 and 58 of the tape modules 22*a*, 22*b* and 22*c*. In this first position, the modules may be stored, or transported, and preferably include a dummy circuit board 20*a* which may be plastic or cardboard and is inserted into means for receiving circuit board 20 such as a recess 17 in the second part 14. In addition, the dummy circuit board 20*a* is positioned between the side panels 60 and 62 and between the lead ends 56 and 58 for securely protecting the lead ends 56 and 58.

Figure 5:
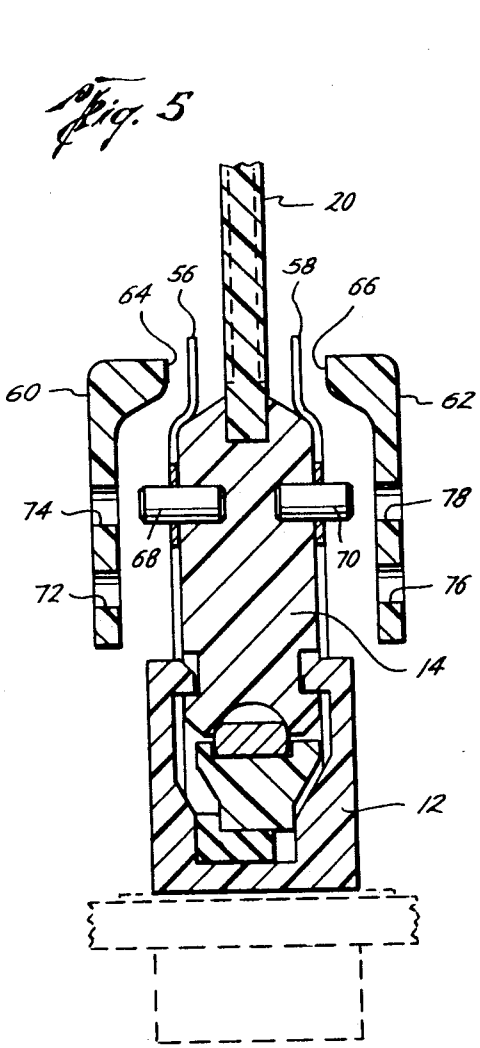
FIG. 5 is a view similar to FIG. 4 showing a further step in the connection of a circuit board to the connector.

While the side panels 60 and 62 may be releasably connected to the second part 14 by any suitable means, as best seen in FIGS. 3, 4 and 5, the releasable connection may include dowel pins 68 and 70 and holes 72, 74, 76 and 78. The dowel pins are secured to either the side panel or the second part 14 and the holes are in the other. As shown, the pins 68 and 70 are secured to part 14 and the holes 72, 74, 76, and 78 are in the side panels 60 and 62, respectively. The dowel pins 68 and 70 maintain a frictional fit in the holes for releasably securing the side panels 60 and 62 in place. For placing the side panels 60 and 62 in the first position, as best seen in FIG. 3, the dowel pins 68 and 70 are frictionally secured in the holes 72 and 76 of the side panels 60 and 62, respectively.

After the connector 10 has been shipped, and it is desired to make a connection between the connector 10 and a daughterboard 20, the first step, as best seen in FIG. 4, is the removal of the dummy circuit board 20*a* from the part 14, and the insertion of the daughterboard 20 into the receiving recess 17 of the part 14, as best seen in FIG. 5. Also, the side panels 60 and 62 are releasably connected to the second part 14 in a second position. That is, as best seen in FIG. 4, the side panels 60 and 62 are moved transversely relative to the flexible circuit 22*a*, such as by moving the holes 72 and 76 off of the dowel pins 68 and 70. Then, as best seen in FIG. 5, the side panels 60 and 62 are moved longitudinally relative to the flexible tape 22*a* to bring the holes 74 and 78 in alignment with the dowel pins 68 and 70, respectively. The transverse movement of the side panels 60 and 62 insures that they do not contact, scrape and damage the flexible tape 22*a* when they are moved longitudinally. It is also to be noted that in the first position, as best seen in FIG. 3, the support shoulders 64 and 66 extend beyond the edge 50 of the second part 14 further than the lead ends 56 and 58 of the tape 22*a* for protecting the tape ends 56 and 58. However, in moving longitudinally, as best seen in FIG. 5, the side panels 60 and 62 move to a position exposing the ends 56 and 58 of the tape 22*a* for bonding them to the daughterboard 20.

Referring now to FIG. 6, the side panels 60 and 62 have been releasably connected again to the second part 14, but in a second position with the dowel pins 68 and 70 in the holes 74 and 78 of the side panels 60 and 62, respectively. In this position, the support shoulders 64 and 66 of the side panels 60 and 62 engage and support the leads 56 and 58 adjacent to but spaced from the ends for providing support while bonding the leads 56 and 58 to the daughterboard 20. That is, the shoulders 64 and 66 provide a compressive force on the tape ends 56 and 58 to physically maintain a contact to and alignment with the bond pads on the circuit board 20. This operation enhances the bondability and reliability of the bonding process. That is, a physical contact of the flexible circuit leads 56 and 58 to the bond sites on the board 20 is an important requirement to achieve a reliable bond. Thereafter, the leads 56 and 58 are bonded at bonds 80 and 82 to the circuit board 20 by any suitable bonding means such as thermo-compression bonding. After bonding, as best seen in FIGS. 6 and 7, the side panels 60 and 62 remain in place and protect the flexible tapes 22*a*, 22*b* and 22*c* from operational/installation damage.

Referring again to FIGS. 3, 4 and 5, while it is noted that the side panels 60 and 62 may be removed while or before removing the dummy board 20*a* and inserting the daughterboard 20, the side panels 60 and 62 may remain in place, as in FIG. 3, while the dummy board 20*a* is removed and the daughterboard 20 is inserted. This may be advantageous in some instances in order to prevent damage to the flexible circuit leads 56 and 58 during the insertion of the circuit board 20 into the recess 17 and connection to the part 14.

Figure 10:
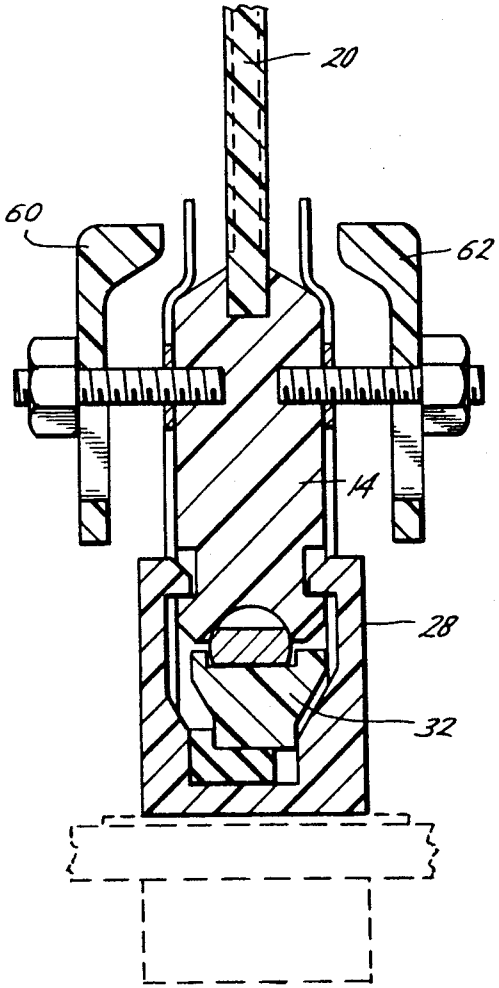
FIG. 10 is a view similar to FIG. 9 showing the releasable connector in a mid-position.
Figure 9:
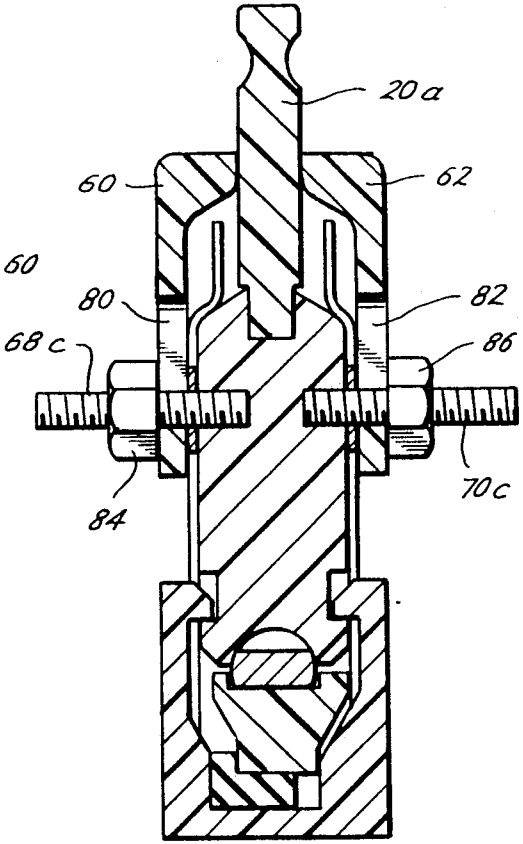
FIG. 9 is a cross-sectional section similar to FIG. 3 uses the releasable connection of FIG. 8.
Figure 8:
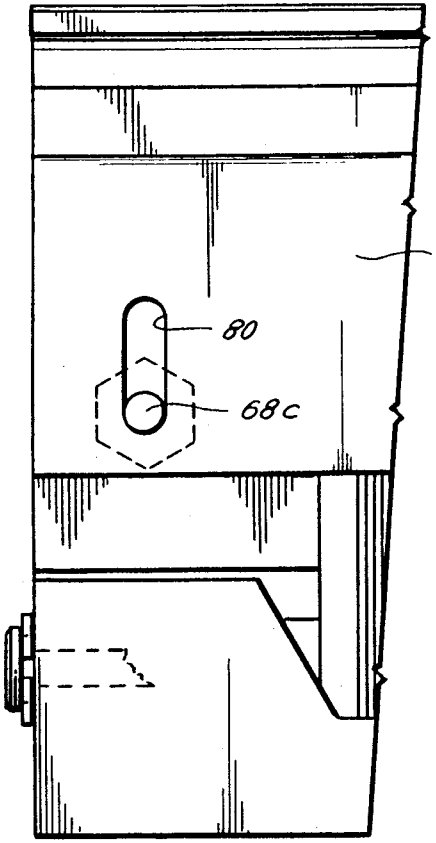
FIG. 8 is a fragmentary, elevational view, illustrating another embodiment of a releasable connection between the side panels and the connector.

While the releasable connection between the side panels 60 and 62 and the second part 14 has been shown in FIGS. 3-6 as friction fitting dowel pins and holes, other suitable type of releasable connecting means may be used. For example, in FIG. 6A, threaded bolts 68*a* and 70*a* may be used in place of the dowel pins 68 and 70. And in FIG. 7A, instead of dowel pins, a spring metal split tubular pin 68*b*, sold under the trademark "Tension Pin" may be utilized to maintain a fixed frictional fit in an undersized hole. In FIGS. 8, 9 and 10, threaded pin 68*c* and 70*c* are utilized extending through elongated slots 80 and 82 in the side panels 60 and 62, respectively. Thus, the coacting nuts 84 and 86 may be loosened as best seen in FIG. 10 to transversely move the side panels 60 and 62 away from the flexible tapes. Thereafter, the side panels 60 and 62 may be moved longitudinally relative to the tapes by virtue of the slots 80 and 82. The nuts 84 and 86 may then be tightened to position the side panels 60 and 62 in either the desired first or second positions as previously described.

The present invention protects the flexible tape, and particularly the bonding sites on the tape, during storage and shipment to the user. The invention also provides support for the tape lead ends during bonding operations. And after the circuit board installation, the side panels continue to provide protection to the bonded tapes.

The present invention, therefore, is well adapted to carry out the objects and attain the ends and advantages mentioned as well as others inherent therein. While presently preferred embodiments of the invention have been given for the purpose of disclosure, numerous changes in the details of construction, arrangement of parts, and steps of the process, will be readily apparent to those skilled in the art, and which are encompassed within the spirit of the invention and the scope of the appended claims.

What is claimed is:

1. An electrical connector having first and second coacting and releasable parts, each of said parts including a plurality of spaced electrical contacts for connection to the contacts on the other part comprising, the electrical contact on said second part including a flexible electrical tape having a plurality of lead ends for connection to a circuit board, means on the second part for coacting with and receiving a circuit board, and a side panel having a lead support shoulder, said panel being releasably connected to the outside of said second part in first or second positions, in said first position said panel encloses and protects the lead ends of the flexible tape, and in said second position the lead support shoulder engages the lead ends adjacent to but spaced from the ends for providing support for bonding the leads to a circuit board.

2. The apparatus of claim 1 wherein the side panel is movable between the first and second positions in a direction transverse to the flexible electrical tape for avoiding a scraping contact on the tape between positions.

3. The apparatus of claim 1 including a releasable connection between the side panel and the second part which includes pins and holes.

4. The apparatus of claim 1 including a releasable connection between the side panel and the second part which includes a pin and slot connection.

5. The apparatus of claim 1 including, a dummy circuit board initially and releasably connected to the second part.

6. An electrical connector having first and second coacting and releasable parts, each of said parts including a plurality of spaced electrical contacts for connection to the contacts on the other part comprising, said second part having first and second edges and opposite sides, and the electrical contacts on the second part including a flexible electrical tape having a plurality of lead ends at each end for connection to a circuit board, said tape wrapped around the second edge of the second part and extending on opposite sides with each of the ends being positioned adjacent the first edge of the second part, means on the first edge of the second part for coacting with and receiving a circuit board for connection to each of the ends of the flexible electrical tape, and first and second side panels, each having a lead support shoulder, said side panels being releasably connected to opposite sides of the second part in first or second positions, in said first position said panels enclose and protect the lead ends of the flexible tape, and in the second position the lead support shoulders engage one of the ends of the flexible tape adjacent to but spaced from the ends for providing support for bonding the ends to a circuit board connected to the first edge of the second part.

7. A method of protecting the ends of a flexible circuit tape in an electrical connector having first and second coacting and releasable parts in which the second part includes a flexible electrical tape having a plurality of lead ends extending along a side to adjacent an edge of the second part comprising, releasably connected a side panel to the side of the second part in which the side panel extends beyond the edge of the second part further than the lead ends of the tape for protecting the tape ends, connecting a circuit board to the second part on one side of the lead ends of the tape, moving the side panel to a position exposing the tape ends, compressing the lead ends against the circuit board by the side panel while connecting the side panel to the side of the second part, and bonding the lead ends to the circuit board.

8. The method of claim 7 including, initially connecting a dummy circuit board to the second part on the one side of the lead ends of the tape, and removing the dummy prior to connecting an active circuit board.

9. The method of claim 7 including, moving the side panel transversely to the flexible tape before moving the side panel to a position exposing the tape ends.

10. A method of protecting the ends of a flexible circuit tape in an electrical connector having first and second coacting and releasable parts in which the second part includes first and second edges and opposite sides between the edges, and a flexible electrical tape having a plurality of lead ends at each end for connection to a circuit board in which the tape is wrapped around the second edge of a second part and extends on opposite sides with each of the ends positioned adjacent the first edge of the second part comprising, releasably connecting a side panel having a support shoulder to each side of the second part in a first position in which the shoulders extend beyond the lead ends of the tape for protecting the tape ends, connecting a circuit board to the first edge of the second part between the ends of the tape, moving the side panels to a second position exposing the tape ends, compressing the lead ends against the circuit board by the support shoulders and connecting the side panels to the sides of the second part, and bonding the lead ends to the circuit board.

11. The method of claim 10 including, moving the side panels transversely to the tape when moving from the first position to the second position for avoiding damaging the tape.

12. The method of claim 10 including, protecting the ends of the flexible tape by the shoulders while connecting the circuit board to the second part.

* * * * *

UNITED STATES PATENT OFFICE

CERTIFICATE OF CORRECTION

Patent No. 5,049,087 Dated September 17, 1991

Inventor(s) Chang-Hwa Chung

It is certified that error appears in the above-identified patent and that said Letters Patent is hereby corrected as shown below:

Column 8, line 37, delete "connected" and insert -- connecting --

Signed and Sealed this

Twenty-third Day of February, 1993

*Attest:*

STEPHEN G. KUNIN

*Attesting Officer*

*Acting Commissioner of Patents and Trademarks*